US005549483A

United States Patent [19]

Hotea

[11] Patent Number: 5,549,483

[45] Date of Patent: Aug. 27, 1996

[54] ELECTRICAL TERMINAL WITH LEAD STRAIN RELIEF MEANS

[75] Inventor: Gheorghe Hotea, Griesheim, Germany

[73] Assignee: The Whitaker Corporation, Wilmington, Del.

[21] Appl. No.: 258,646

[22] Filed: Jun. 13, 1994

[30] Foreign Application Priority Data

Jul. 2, 1993 [GB] United Kingdom ..... 9313652

[51] Int. Cl.[6] ..... H01R 4/24

[52] U.S. Cl. ..... 439/399; 439/877

[58] Field of Search ..... 439/395–406, 439/877–881, 374

[56] References Cited

U.S. PATENT DOCUMENTS

| | | | |
|---|---|---|---|
| 3,335,392 | 8/1967 | Elliott . | |
| 3,662,089 | 5/1972 | Harding | 439/877 |
| 3,715,457 | 2/1973 | Teagno et al. | 439/877 |
| 4,264,118 | 4/1981 | Nijman | 339/99 |
| 5,254,021 | 10/1993 | Yamamoto et al. | 439/877 |

FOREIGN PATENT DOCUMENTS

| | | | |
|---|---|---|---|
| 1140227 | 1/1983 | Canada | 439/399 |
| 0352966A1 | 1/1990 | European Pat. Off. . | |
| 0496287 | 7/1992 | European Pat. Off. . | |
| 0534276 | 3/1993 | European Pat. Off. . | |
| 8608199.3 | 3/1986 | Germany . | |

*Primary Examiner*—David L. Pirlot
*Attorney, Agent, or Firm*—Driscoll A. Nina

[57] ABSTRACT

An electrical terminal comprises a mating portion, a wire connecting portion and a lead strain relief portion. The lead connecting portion comprises insulation slitting edges and indents for penetrating the insulation of an insulated lead to make electrical connection with the metal core of the lead. The lead strain relief portion comprises three ears upstanding from respective sidewalls projecting from opposite edges a base. Each ear is formed with triangular shaped barb projecting inwardly of the strain relief portion and having a sharp edge from which extends an end edge facing the wire connecting portion. The base of the strain relief portion has a quadrangular array of spurs having sharp apices projecting into the strain relief portion. The ears can be crimped about the insulation of the lead when it has been forced into the wire connecting portion so that the barbs and the spurs bite into the insulation of the lead thereby preventing axial movement of the lead away from the wire connecting portion when tension is applied to the lead, so that the electrical connections between the indents and the lead core are unimpaired.

14 Claims, 3 Drawing Sheets

ELECTRICAL TERMINAL WITH LEAD STRAIN RELIEF MEANS

BACKGROUND OF THE INVENTION

1. Field of the Invention

This invention relates to an electrical terminal with lead strain relief means, which is especially suitable for use in the automotive industry.

2. Description of the Prior Art

There is described in DE-U-8608199.3, an electrical terminal having a longitudinal axis and comprising a mating portion, a wire connecting portion connected to one end of the mating portion and a lead strain relief portion connected to the opposite end of the wire connecting portion, the wire connecting portion being adapted to make electrical connection to the metal core of an insulated electrical lead and the lead strain relief portion comprising a base and upstanding ears adapted to be crimped about the insulation of the lead to restrain axial movement of the lead away from the wire connecting portion.

When crimped to the insulation of the lead, the ears of the lead strain relief portion serve to grip the lead in order to protect the electrical connection between the core of the lead and the wire connecting portion when a tensile force is applied to the lead in a direction away from the wire connecting portion. Such terminals are commonly used in the automotive industry in insulating housings which are adapted to mate with corresponding insulating housing for mating electrical connectors. When an automotive vehicle is being serviced, there is a standing temptation for the service mechanic to disconnect one electrical connector from another by pulling upon the leads of the terminals of the one connector. Especially where the housings of mating connectors are difficult to disengage, the tensile force applied to a lead may well impair its electrical connection with the terminal from which the lead extends. The lead strain relief protection afforded by the lead strain relief portion of the known terminal described above, is solely dependent upon the frictional engagement between the ears of the lead strain relief portion and the insulation of the lead.

SUMMARY OF THE INVENTION

According to the present invention, an electrical terminal as defined in the second paragraph of this specification is characterized in that each ear is formed with a barb projecting inwardly of the strain relief portion and being adapted to bite into the insulation of the lead when the ears have been crimped thereabout, each barb having a sharp edge directed inwardly of the strain relief portion and an end edge extending from the sharp edge and facing the wire connecting portion.

The ears thus serve greatly to increase the resistance of the lead to being pulled away from the wire connecting portion of the terminal.

For reinforcement of each barb in the axial direction, it may be of triangular shape, tapering away from the wire connecting portion, the end edge preferably extending at right angles to the longitudinal axis of the terminal.

For the maximum effectiveness of the ears combined with economy of material of the wire connecting portion, the ears may be three in number, each ear upstanding from a respective side wall of the lead strain relief portion, two of the ears upstanding from one side wall in axially spaced relationship and the remaining ear upstanding from the opposite side wall at a position between said two ears.

The ears may be assisted by spurs upstanding from the base of the lead strain relief portion so as to bite into the insulation of the lead when the ears have been crimped thereabout, the spurs being arranged, preferably, in a quadrangular array, for ease in providing them.

According to a preferred embodiment of the invention, the wire connecting portion is insulation displacing and comprises side walls upstanding from opposite edges of a floor and having insulation displacing indents surmounted by insulation slitting edges which slit the insulation of the lead as it is forced into the wire connecting portion so that the indents penetrate the insulation of the lead and make firm electrical connection with the metal core thereof.

DETAILED DESCRIPTION OF THE PREFERRED EMBODIMENT

Figure 1:
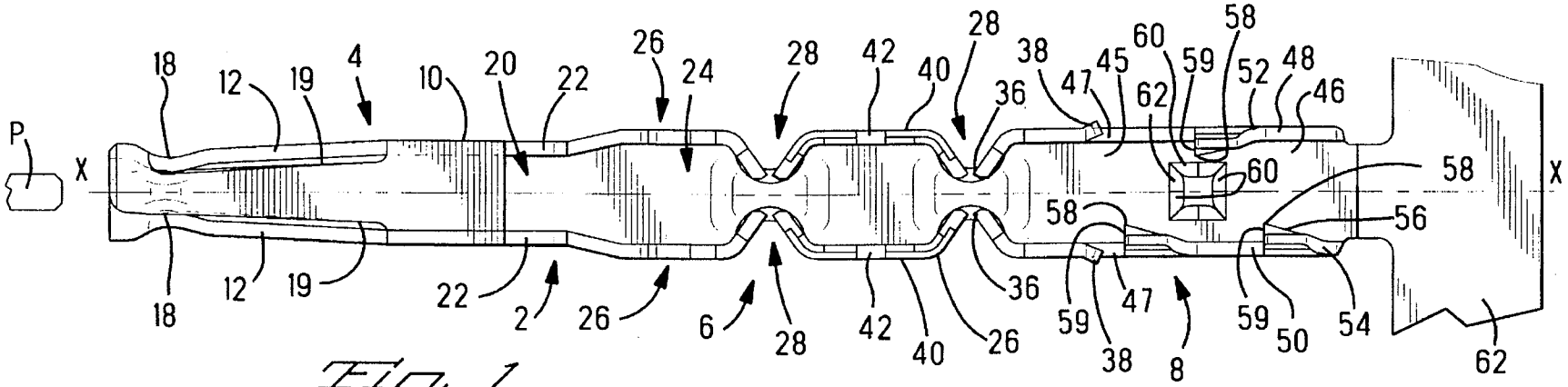
FIG. 1 is a top plan view of an electrical terminal according to said embodiment, connected to a carrier strip.
Figure 2:
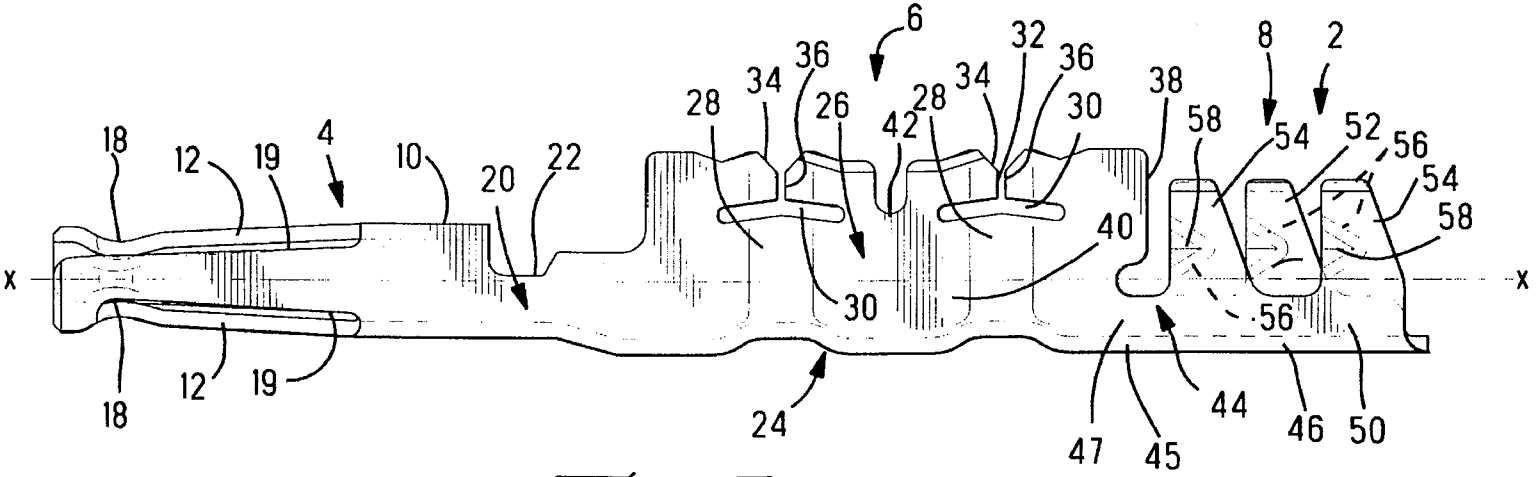
FIG. 2 is a side view of the terminal without the carrier strip.

As shown in FIG. 1 and 2 a one-piece stamped and formed electrical terminal 2 comprises a mating portion 4 in the form of an electrical pin socket, an insulation displacement wire connecting portion 6 and an insulation gripping lead strain relief portion 8.

Figure 5:
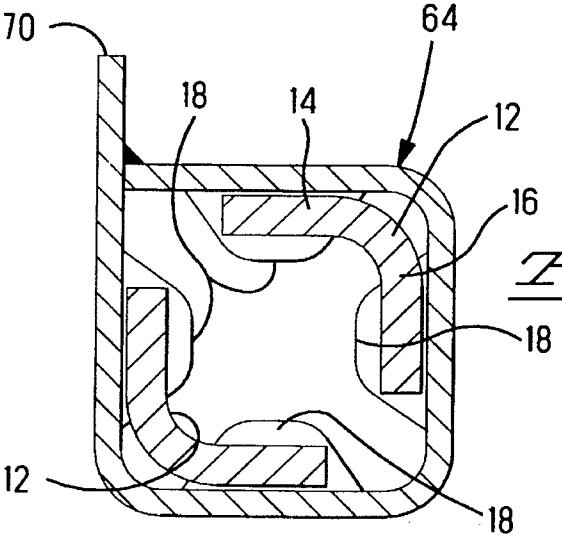
FIGS. 4 and 5 are views taken on the lines 4—4 and 5—5 of FIG. 3, respectively.

The mating portion 4, which is of known construction, comprises a base 10 from which extend two contact springs 12 each comprising an L-cross section forward portion having identical parts 14 and 16 which extend at right angles to each other as shown in FIG. 5. The parts 14 and 16 have contact bosses 18. Rearwardly of the contact bosses 18, each contact spring 12 has a longitudinal slot 19 which enables the parts 14 and 16 of the spring 12 to splay resiliently apart from each other when a square cross section pin P is inserted into the mating portion 4 between the bosses 18. The mating portion 4 is joined to the wire connecting portion 6 by a U cross section first transition portion 20 defining recesses 22 proximate to the mating portion 4.

The wire connecting portion 6, which is elongate and is of substantially U shaped cross section comprises a floor 24 and opposed side walls 26 upstanding from opposite edges of the floor 24. Each side wall 26 has two insulation displacing inwardly bowed indents 28 spaced from each other lengthwise of the longitudinal axis X-X of the terminal 2, each indent 28 on one side wall 26 being opposite to a respective indent 28 of the other side wall 26. The indents 28, which are parallel to each other are elongate in a direction normal to the floor 24. Each indent 28 is formed with a transverse slot 30 towards its upper longitudinal edge, which slot communicates with a central vertical slot 32 of substantially smaller width than the slot 30, opening into a free longitudinal edge of the side wall 26. Each indent 28 is thereby surmounted by a pair of blades 34 having sharp, opposed, insulation slitting edges 36. At its end remote from the mating portion 4, each side wall 26 terminates in an outwardly flared, lead guiding flange 38. A central part 40, between the indents 28 of each side wall 26 is formed with a central recess 42 opening into the free longitudinal edge of the side wall 26 to enhance the resilience of the central part 40.

Figure 3:
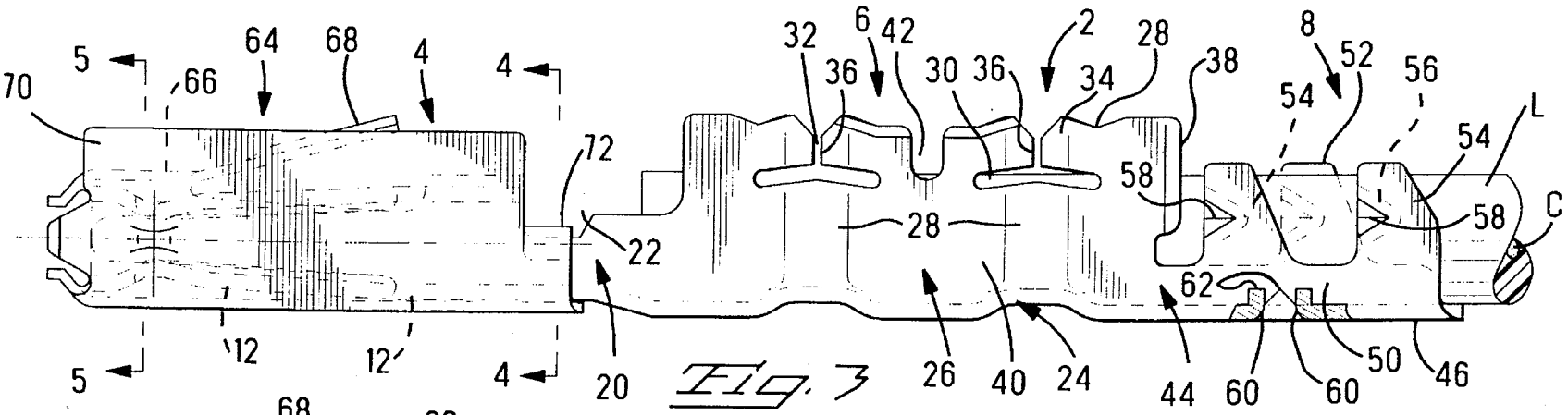
FIG. 3 is a side view of the terminal when it has been connected to an insulated electrical lead and with a protective metal sleeve assembled to a mating portion of the terminal, a detail of which is shown in section.

The wire connecting portion 6 is connected to the strain relief portion 8 by way of a second transition portion 44 having a base 45 and side wall 47 upstanding from opposite edges of the base 45, each side wall 47 being a continuation of a respective side wall 26 of the wire connecting portion 6. The lead strain relief portion 8 is elongate and is of substantially U shaped cross section having flat base 46 from opposite edges of which upstand side walls 48 and 50, respectively. Each side wall 48 and 50 is a continuation of a respective side wall 47 of the transition portion 44. Side walls 48 and 50 are of the same height as the side walls 47 which are of substantially smaller height than the side walls 26. There upstands from the free longitudinal edge of the side wall 48 of the strain relief portion 8, a single crimping ear 52 centrally of the length of the side wall 48. From the free longitudinal edge of the side wall 50, there upstand two axially spaced crimping ears 54 on each side of the crimping ear 52. The ears 52 and 54 are of the same height as each other and each tapers slightly in a direction away from the base 46 and has a chamfered free end remote therefrom. There projects from the inner face of each crimping ear 52 and 54, intermediate its length, a triangular shaped barb 56 which tapers away from the wire connecting portion 6 and terminates, at its end nearest to the wire connecting portion 6, in a sharp insulation piercing edge 58 directed inwardly of the strain relief portion 8, and in a rectilinear end edge 59 which extends from the sharp edge 58, at right angles to the axis X-X of the terminal and faces towards the wire connecting portion 6. At a position opposite to the ear 52 and between the ears 54, there upstands from the base 46, a central, quadrangular, array of four internal, triangular, spurs 60, each tapering normally away from the base 46 and terminating in a sharp insulating piercing apex 62 as best seen in FIG. 3.

Figure 6:
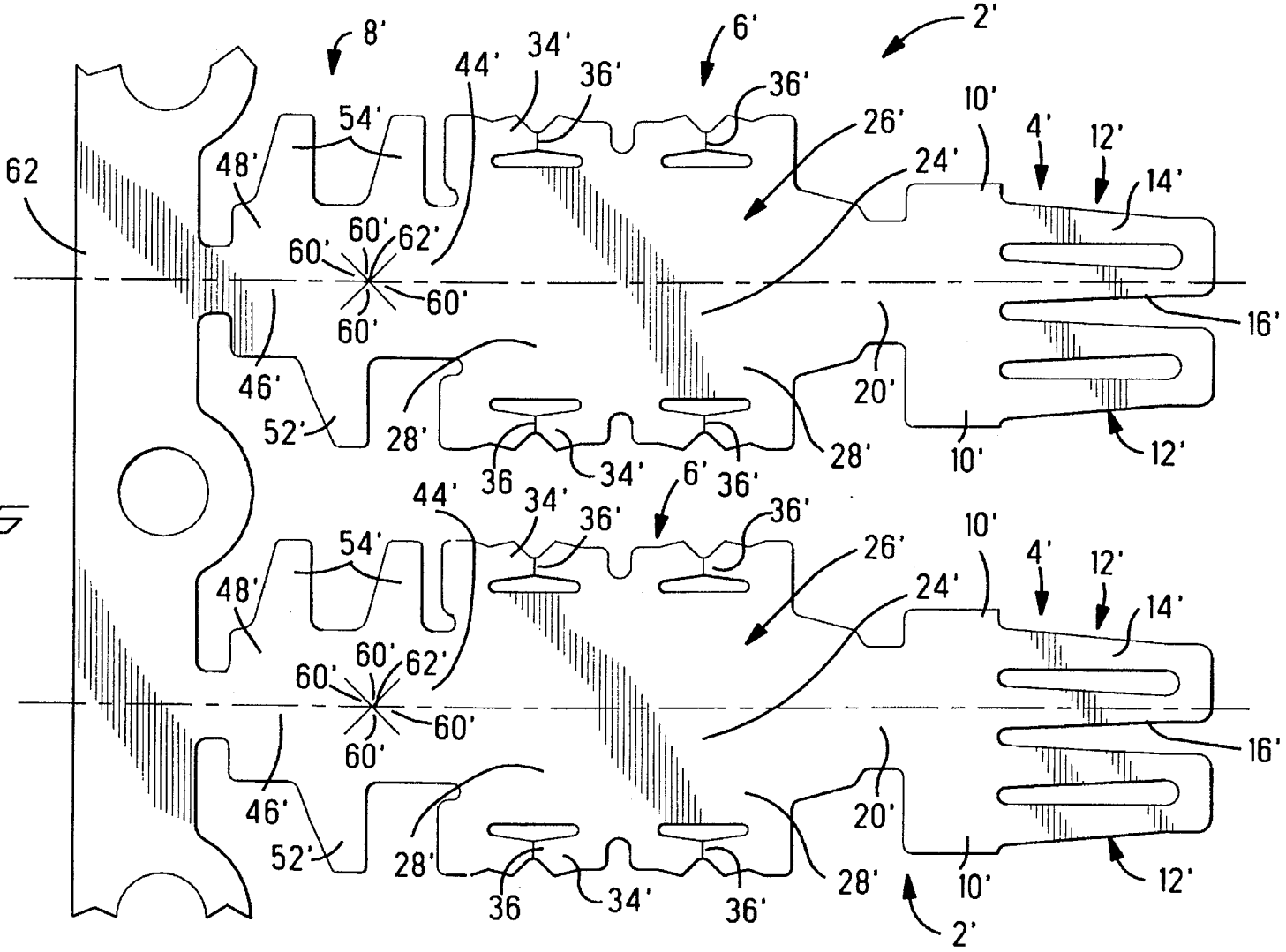
FIG. 6 is a plan view of two sheet metal blanks connected to a carrier strip during a progressive stamping and die forming operation for producing terminals according to said embodiment.

FIG. 6 shows two blanks 2' of a strip of stamped out sheet metal blanks, at a stage during a progressive stamping and die forming operation for producing terminals 2. The blanks 2' of the strip of blanks are connected for the purpose of said operation, by a carrier strip 62. In FIG. 3, the parts of each blank 2' bear the same reference numerals as corresponding parts of the terminal 2 but with the addition of a prime symbol. As shown in FIG. 6, the spurs 60' are defined, before being struck out, by making a cruciform shear in the portion 46' of the blank 2.

Figure 4:
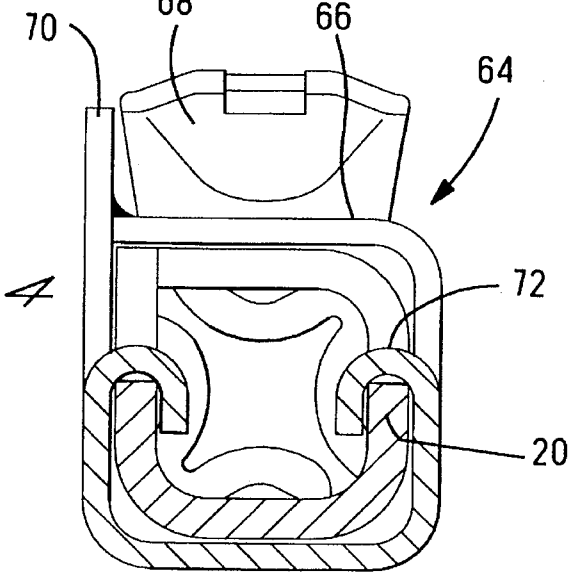

In order to prepare a terminal 2 for insertion into a respective cavity in an insulating housing (not shown), a protective metal sleeve 64 (FIGS. 3 to 5) is assembled to the mating portion 4 of the terminal 2. The sleeve 64, which is of substantially rectangular cross section, has struck from its upper wall 66 a latching tongue 68 for engaging in said cavity to restrain the terminal 2 from withdrawal therefrom. One side wall of the sleeve 64 projects above the wall 66 to provide a keying plate 70 for reception in a keyway in the housing for properly orienting the terminal 2 in its cavity. The sleeve 64 is secured to the terminal 2 by clinching ears 72 on the sleeve 64 clinched into the recesses 22 of the transition portion 20 and over the side walls thereof as best seen in FIG. 4.

When the terminals 2 have been fully formed, the strip of terminals may be fed with the aid of the carrier strip 62, through a lead insertion station (not shown) at which an insulated lead L having a central metal core C is forced in to the wire connecting portion 6 of each terminal 2 so as to lie in the strain relief potion 8 thereof. The strip of terminals 2 is then fed through a crimping station (not shown) at which the ears 52 and 54 of each terminal 2 are crimped about the insulation of the respective lead L, the terminal 2 being simultaneously sheared from the carrier strip 62.

Initially, as a lead L is inserted into the wire connecting portion 6 of a terminal 2, this being in a direction at right angles to the length of the lead L, the sharp edges 36 of the blades 34 slit the insulation of the lead on each side thereof in a direction at right angles to the length of the lead L, so that as the lead L is further forced into the wire connection portion 6 of the terminal, the crests of the inwardly bowed indents 28 penetrate the slits in the insulation to make firm electrical contact with the metal core C of the lead L.

When the ears 52 and 54 are crimped about the insulation of the lead L and are thereby curled thereover, the sharp edges 58 of the barbs 56 are driven into the insulation of the lead L and the lead L is forced down against the sharp apices 62 of the spurs 60 so that they are driven into the insulation of the lead L. Thus if the lead L is pulled with the terminal 2 secured in its cavity in the housing, the barbs 56 tend to bite further into the insulation of the lead L and so prevent its axial movement with respect to the terminal 2, assisted by the spurs 60, whereby the electrical connections between the lead core C and the indent 28 the wire connecting portion 6 are unimpaired by the tension applied to the lead L. Optimally, the strain resistance of the strain relief portion 8 should be equivalent to that of a crimped connection between a wire and a crimping ferrule and should certainly not to be less than that afforded by the wire connecting portion 6 itself.

It has been found that for adequate strain relief and at the same time maximum economy of the material of the strain relief portion 8, the latter should be provided with three ears, as described above, two on one side of the portion 8 and one on the other side thereof. The provision of a fourth ear axially spaced from ear 52 and from the ears 54 involve lengthening the portion 8 so that a substantially greater amount of metal would be needed to produce it. The mating portion of the terminal could for example be a male member instead of a socket, and the wire connecting portion could for example, be a ferrule for crimping about the stripped end of the core of an insulated lead.

I claim:

1. An electrical terminal having a longitudinal axis and comprising a mating portion, a wire connecting portion connected at one end to the mating portion and a lead strain relief portion connected to the opposite end of the wire connecting portion, and being adapted to make electrical connection to the metal core of an insulated electrical lead, and the lead strain relief portion comprising a base and upstanding ears projecting away from the base and adapted to be crimped about the insulation of the lead to restrain axial movement of the lead away from the wire connection portion; characterized in that each ear is formed with a barb projecting inwardly of the strain relief portion and being adapted to bite into the insulation of the lead when the ears have been crimped thereabout each barb having a sharp edge directed inwardly of the strain relief portion and an end edge extending from the sharp edge and facing the wire connecting portion; whereby the sharp edge bites into the insulation of the insulated electrical lead while maintaining an approximately linear wire path.

2. A terminal as claimed in claim 1, characterized in that each barb is of triangular shape and tapers away from the wire connecting portion, the end edge extending at right angles to the longitudinal axis of the terminal.

3. A terminal as claimed in claim 1, characterized in that the ears are three in number, each ear extending from a respective sidewall of the lead strain relief portion, two of the ears upstanding from one sidewall in axially spaced relationship, the other ear upstanding from the opposite sidewall at a position between said two ears.

4. A terminal as claimed in claim 1, characterized by a plurality of spurs upstanding from a base of the lead strain relief portion, so as to bite into the insulation of the lead when the ears have been crimped thereabout.

5. A terminal as claimed in claim 4, characterized in that the spurs are of triangular shape, with pointed apices thereof directed away from the base.

6. A terminal as claimed in claim 4, characterized in that the spurs are four in number and are arranged in a quadrangular array.

7. A terminal as claimed in claim 4, characterized in that the spurs are arranged between a pair of the ears upstanding from one sidewall of the base of the strain relief portion and opposite to a further ear, upstanding from an opposite side wall of the base.

8. A terminal as claimed in claim 1, characterized in that the wire connecting portion is of substantially U-shaped cross section, comprising a floor and opposed sidewalls upstanding from opposite edges of the floor, each sidewall of the wire connecting portion having an inwardly bowed indent which is elongate normally of the base, each indent being surmounted by a pair of opposed, sharp, insulation splitting edges remote from the floor for slitting the insulation of an electrical lead forced between the opposed sidewalls, to allow the indent to penetrate the insulation of the lead to make electrical connection the metal core of the lead.

9. A terminal as claimed in claim 8, characterized in that each sidewall of the wire connecting portion has a plurality of said indents spaced from each other axially of the terminal, each indent of one of these sidewalls being opposite to a corresponding indent of the other sidewall.

10. A terminal as claimed in claim 9, characterized in that each pair of insulation splitting edges is provided on a blade defined by a first slot extending across the indent and a second slot extending vertically of the indent, communicating with the first slot and opening into a free longitudinal edge of the respective sidewall of the wire connecting portion.

11. An electrical terminal, comprising:

a mating portion for matable engagement with a matable contact;

a wire connecting portion connected at one end to the mating portion for electrical connection to a metal core of an insulated electrical lead;

a strain relief portion connected to an opposite end of the wire connecting portion for strain relief connection to insulation of the insulated electrical lead;

said strain relief portion including a base and upstanding ears extending away from said base; and each of said upstanding ears having an inwardly-directed barb adjacent a forward end thereof, said inwardly directed barb having a longitudinal sharp edge and an end edge extending from said sharp edge and facing the wire connecting portion, the inwardly-directed barbs biting into the insulation of the insulated electrical lead when the upstanding ears are crimped onto the insulated electrical lead; _whereby the sharp edge bites into the insulation of the insulated electrical lead while maintaining an approximately linear wire path.

12. An electrical terminal as claimed in claim 11, wherein said end edge of said inwardly-directed barb is included in a forward edge of each of said upstanding ears.

13. An electrical terminal as claimed in claim 11 wherein said barb is of a triangular configuration and tapers in a direction away from said wire connecting portion.

14. An electrical terminal as claimed in claim 11, wherein said upstanding ears are three, each of said upstanding ears extending from a respective sidewall extending from said base, two of said upstanding ears extending from one sidewall in axially spaced relationship, the other of said upstanding ears extending from the other sidewall at a position between the two of said upstanding ears.

* * * * *